United States Patent [19]

Biller

[11] 4,057,775

[45] Nov. 8, 1977

[54] SUPPORT ASSEMBLY FOR FUSIBLE ELEMENT OF A HIGH VOLTAGE FUSE

[75] Inventor: Bruce A. Biller, Chicago, Ill.

[73] Assignee: S & C Electric Company, Chicago, Ill.

[21] Appl. No.: 633,293

[22] Filed: Nov. 19, 1975

[51] Int. Cl.[2] ..... H01H 85/02

[52] U.S. Cl. ..... 337/186; 337/190

[58] Field of Search ..... 337/158, 159, 186, 190, 337/201, 205, 227, 297

[56] References Cited

U.S. PATENT DOCUMENTS

| | | | |
|---|---|---|---|
| 3,437,971 | 4/1969 | Mikulecky | 337/158 |
| 3,599,138 | 8/1971 | Kozacka | 337/159 |
| 3,863,187 | 1/1975 | Mahieu et al. | 337/159 X |
| 3,962,666 | 6/1976 | Knapp | 337/159 |

*Primary Examiner*—George Harris

*Attorney, Agent, or Firm*—Kirkland & Ellis

[57] ABSTRACT

A support assembly for a helically wound fusible element of a high voltage fuse is fabricated from two identical pieces of insulating material that are formed with mating center slots so that the pieces can be reversed and joined one over the other along the slots to form a x-shaped support member. Finger projections having recesses for supporting a fusible element are formed along the edges of the pieces in such a positional relationship that when the pieces are joined together, the recesses are positioned to form the required helical path for the fusible element. A metallic terminator member may be mounted at each end of the support member to position and mount the support member within the fuse in a fixed position. The terminator members include a center keyed opening that receives the support member and positions and retains the support member. A wire retainer can be used to engage grooves in the ends of the support member that extend through the keyed opening to lock the terminator member to the support member.

21 Claims, 7 Drawing Figures

4
44
26
24
62
64
60
64
62
60
44
50
22
56
58
46
28
66
66
48
50
50
52
54
5
4

60
D3
D2
44
D4
42
60
40
44
D1
D2
D2

12
6
5
50
50
48
46
12
52
22
66
50
56
12
6

22
54
76
A
58
52
56

56
22
52
76
54

SUPPORT ASSEMBLY FOR FUSIBLE ELEMENT OF A HIGH VOLTAGE FUSE

BACKGROUND OF THE INVENTION

1. Field of the Invention

The present invention relates to high voltage fuse construction, and more particularly to support assemblies for supporting fusible elements in high voltage fuses.

2. Description of the Prior Art

High voltage current limiting fuses are well known to the art. Prior art current limiting fuses typically comprise a hollow insulated cylindrical housing which is closed at both ends by metallic end walls. A helically wound fusible element is positioned within the housing and is connected to the end walls. The current limiting fuses are typically filed with an electrically non-conducting insulating material such as silica or quartz sand which surrounds the fusible element. Since it is necessary to assure that the fusible element maintains the proper distance from the sides of the insulated housing and that the individual turns of the fusible element are maintained at a uniform distance to assure that there is no arcing between the turns, prior art current limiting fuses have typically included a support assembly for supporting the fusible element within the fuse housing.

Some prior art current limiting fuses utilize molded or machined ceramic cores for supporting the fusible element. Such ceramic cores are fragile and care must be exercised in handling and storing to assure that the ceramic core is not damaged. In addition, because of the fragile nature of the ceramic cores, the supporting flanges or fingers which position the fusible element must be of substantial size which reduces the amount of sand filler material surrounding the fusible element, particularly where the fusible element engages the supporting fingers. Thus, at those points, there is a reduced ability of the sand to absorb the vaporized fusible element when it fuses thereby restricting fulgurite growth resulting in higher "let through" currents during fuse operation.

Another type of support assembly for a current limiting fuse is disclosed in U.S. Pat. No. 3,863,187 — Mahieu et al. issued Jan. 28, 1975. The support member disclosed in this patent consists of two strips of Mylar plastic which are formed into 90° sectors and welded together using a hot perforating tool. However, fabrication using this technique requires proper vertical and horizontal alignment, and misalignment can result in rejectability of the support member thereby increasing the cost of manufacture. Such support members do not demonstrate good strength characteristics, and since such support members are formed of an organic plastic, a gas is produced due to the decomposition of this material during fuse operation which results in substantial increases in internal pressure in the fuse which may, if excessive, result in rupture of the fuse housing.

Further, difficulty has been experienced in prior art current limiting fuse constructions in terminating the fusible element. Twisting or distortion of the fusible element at the point of connection within the fuse can result in arcing between turns or damage to the fusible element. Further, since the fusible element is typically fabricated from a silver material, electrical connection of the fusible element by welding can result in damage to the fusible element unless the welding temperatures are held to a relatively low level.

In addition, since cost is always a factor for any commercial item, it is desirable to provide a current limiting fuse construction that minimizes the number of dissimilar parts and facilitates rapid low labor cost assembly. Accordingly, it would be a desirable advance in the art to provide a support assembly for a current limiting fuse that reduces the number of dissimilar parts, reduces the labor expense in construction, and maximizes the amount of sand filler material surrounding the fusible element. In addition, it is desirable to assure that the fusible element will be arranged and retained in such a position that flashover from turn to turn does not occur during fuse operation and that the proper concentric alignment of the fusible element with respect to the walls of the current limiting fuse is maintained to prevent localized overheating of the walls.

BRIEF DESCRIPTION OF THE INVENTION

In accordance with the present invention, a support assembly for supporting in a three-dimensional path at least one fusible element within the body of a fuse comprises a first and a second support member, each of the support members formed of a sheetlike electrically non-conductive material. The support members have a slot formed along the center thereof from one end to at least the middle thereof, and fusible element retaining recesses formed along the edges thereof in a predetermined positional relationship. The first and second support members are identical. One of the support members is reversed, turned approximately 90° with respect to the other support member and joined together one over the other along the slots in such a manner that the fusible element retaining recesses align to form the predetermined three-dimensional path of the fusible element.

Preferably, the support members are fabricated from an inorganic insulating material such as mica or adhesive bonded mica particles. However, if desired, a support member may be fabricated from an organic insulating material such as an insulating material that produces an arc quenching gas when exposed to an electrical arc which may assist in arc extinction at certain current levels.

Thus, it is a primary object of the present invention to provide a support assembly for a fusible element of a high voltage fuse which limits the number of dissimilar parts utilized in the construction.

It is yet a further object of the present invention to provide a support assembly for a fusible element of a high voltage fuse which maximizes the amount of filler material surrounding the fusible element by using thin support members having minimal volume and minimal surface in contact with the fusible element.

Yet another object of the present invention is to provide a support assembly for a fusible element of a high voltage fuse which permits economical fabrication in assembly at relatively low labor costs.

These and other objects, advantages, and features will hereinafter appear, and for the purposes of illustration, but not of limitation, exemplary embodiments of the present invention are illustrated in the accompanying drawings.

DETAILED DESCRIPTION OF THE PREFERRED EMBODIMENTS

Figure 1:
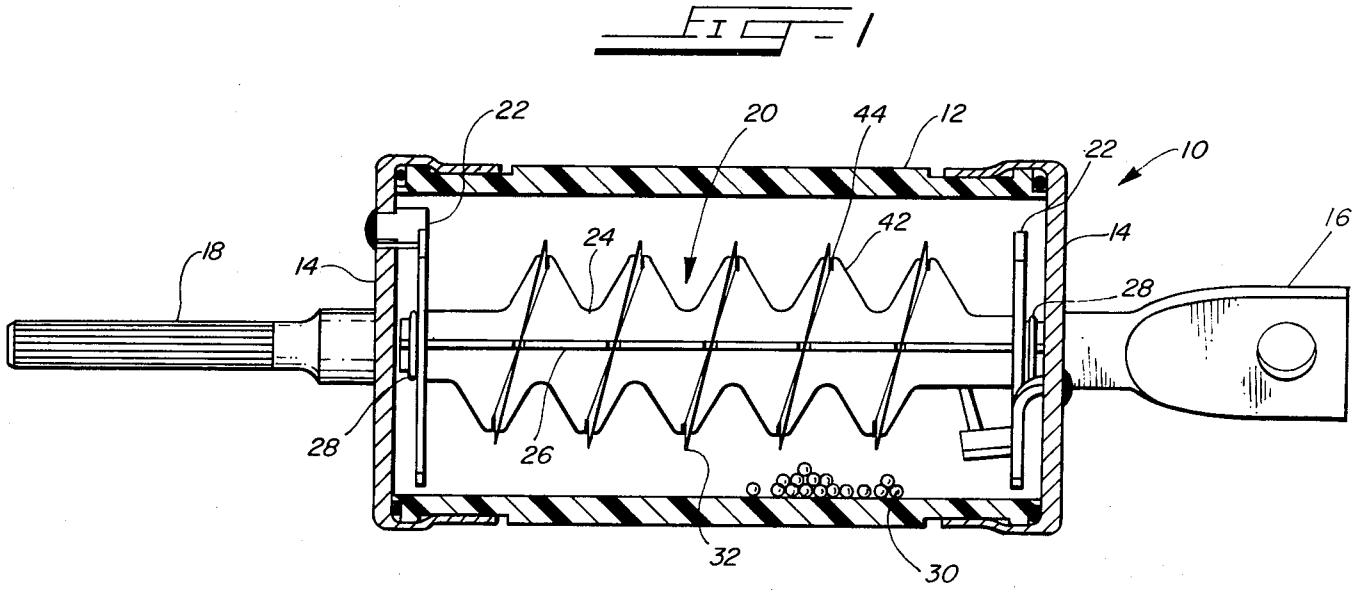
FIG. 1 is a side partially cross-sectional view of one embodiment of the present invention.
Figure 2:
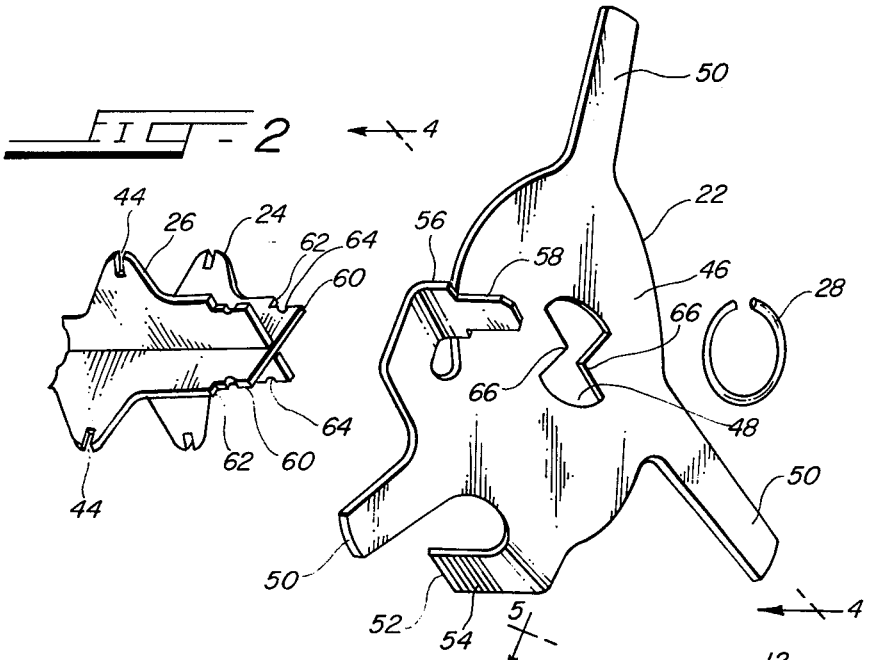
FIG. 2 is an exploded perspective partially fragmentary view of the support assembly of the preferred embodiment of the present invention illustrated in FIG. 1.

With reference to FIGS. 1, and 2 fuse 10 comprises cylindrical housing 12 fabricated from a suitable electrically insulating material such as plastic resin. Mounted over the end of housing 12 are metallic end ferrules 14 upon which a mounting spade 16 and a mounting stud 18 are attached. Spade 16 and stud 18 are used to mount fuse 10 in an electrical circuit. The method of attaching end ferrules 14 to housing 12 does not form a part of the present invention and is more specifically described in co-pending application Ser. No. 633,488 filed Nov. 19, 1975, assigned to the same assignee as the present invention.

Positioned within cylindrical housing 12 is fusible element support assembly 20. Fusible element support assembly 20 comprises first and second support members 24 and 26. Metallic terminator plates 22 are attached to the ends of support members 24 and 26 to provide a means of maintaining support members 24 and 26 in a fixed position within housing 12. However, any suitable means could be used that would hold support members 24 and 26 in a fixed position. Metallic terminator plates 22 do not form a part of the present invention and are more specifically described and claimed in co-pending Application Ser. No. 633,486 filed Nov. 19, 1975, now U.S. Pat. No. 4,010,438, assigned to the same assignee as the present invention. A metallic snap ring retainer 28 engages the ends of first and second support members 22 and 24 to lock terminator plates 22 to the ends of first and second support members 24 and 26. Cylindrical housing 12 may be filled with a suitable granular electrically non-conducting insulating material 30 such as silica or quartz sand which entirely surrounds a thin fusible element 32 which is helically edge wound around first and second support members 24 and 26. Fusible element 32 typically is fabricated of silver and is dimensioned to melt when a predetermined magnitude of current is conducted.

Figure 3:
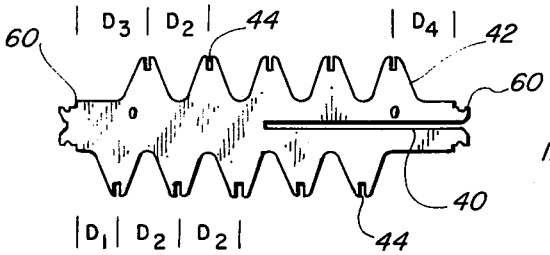
FIG. 3 is a side view of the support member of the support assembly illustrated in FIGS. 1 and 2.

With reference to FIGS. 2 and 3, first and second support members 24 and 26 comprise identical thin flat sheetlike members formed of a suitable electrical insualting material such as Mica as illustrated in FIG. 3 having a center slot 40 that extends from one end thereof to at least the center thereof. The center slot 40 may conveniently be dimensioned to be slightly wider than the thickness of the support members. Each of first and second support members 24 and 26 have projections 42 extending from opposite edges thereof in a predetermined positional relationship which will be more specifically described below. In the ends of each of the projections 42 are fusible elements retaining recesses 44 which are dimensioned to receive the fusible element 32.

Figure 6:
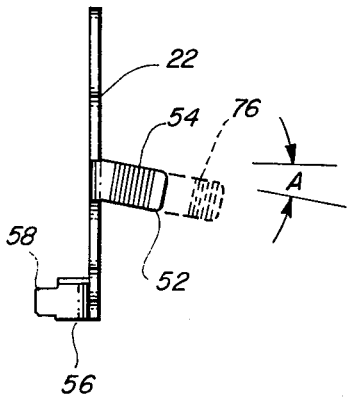
FIG. 6 is an edge view taken substantially along line 6—6 in FIG. 1.

With reference to FIGS. 2, 4, 5, and 6, metallic terminator plates 22 comprise an essentially flat circular portion 46 having a center keyed opening 48 at approximately the center thereof. Extending from the edges of the flat circular portion 46 at 120° intervals are positioning fingers 50. Also extending from the edge of circular portion 46 is serrated tab 52. Serrated tab 52 has a series of grooves 54 on one surface thereof which facilitate the welding of fusible element 32 to serrated tab 52 thereby allowing lower welding temperatures to be utilized reducing the possibility of damage to the fusible element during construction. In addition, serrated tab 52 is bent to be approximately perpendicular to the surface of circular portion 46 in one plane (see FIG. 5), but is bent at an angle A as illustrated in FIG. 6 from the perpendicular position in the perpendicular plane. Angle A is the angle at which serrated tab 52 is essentially perpendicular to the path of helically wound fusible element 32 so that the fusible element 32 does not have to be bent or distorted when being welded to serrated tab 52.

Figure 4:
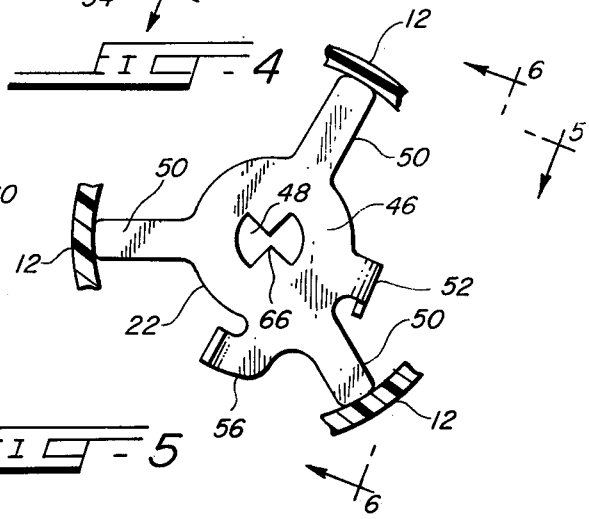
FIG. 4 is a front view of the plate member taken substantially along line 4—4 in FIG. 2.

Also extending from one of the positioning fingers 50 is mounting tab 56. Mounting tab 56 is bent perpendicular to the surface of circular portion 46, and has an end portion 58 of reduced dimension that may be inserted through openings in end ferrules 14 and welded thereto to mount the terminator plates 22 within cylindrical housing 12. As illustrated in FIG. 4, positioning fingers 50 are dimensioned so that they will slide into and rest against the interior surface of cylindrical housing 12 so that the entire support assembly 20 is properly positioned within cylindrical housing 12, thus maintaining fusible element 32 at the proper distance from the interior of housing 12.

Each end of first and second support members 24 and 26 has a reduced portion 60 dimensioned to slide into keyed opening 48 in terminator plate 22. Abutting surfaces 62 are provided at the end of the reduced portion 60 which extend beyond the edges of keyed opening 48 to provide an abutting surface against terminator plates 22. The reduced portion 60 also has a groove 64 formed along the opposite edges thereof for receiving snap ring retainer 28.

To assemble support assembly 20, first and second support members 24 and 26, which are identical members as illustrated in FIG. 3, are reversed, rotated until they are perpendicular to one another and then slid one over the other along the center slot 40 until the ends coincide as illustrated in FIGS. 1 and 2. In this position, first and second support members 24 and 26 form an x-shaped support member. The metallic terminator plates 22 are then positioned over the ends of first and second support members 24 and 26 so that the reduced portion 60 is positioned through keyed opening 48 and snap ring retainer 28 is snapped over the end of first and second support members 24 and 26 until it engages grooves 64 and locks terminator plates 22 to the ends of the support members. In this position, the fusible element retaining recesses on the end 44 on the ends of projections 42 are automatically aligned in the desired helical path of fusible element 32 so that fusible element 32 may be wound around the support assembly 20 and welded to serrated tabs 52.

The retaining recesses 44 align in the proper helical path when first and second support members 24 and 26 are joined along their center slots 40 because of the particular position relationship of the recesses 44. In particular, with reference to FIG. 3, the first retaining recess 44 from the left end of and the bottom of the support member as illustrated in FIG. 3 is positioned a predetermined distance D1 from the end thereof. Thereafter, each of the retaining recesses 44 on that side are separated by a predetermined distance D2 from one another. On the opposite top side of the support member as illustrated in FIG. 3, the first retaining recess 44 is positioned a distance D3 from the end thereof, and distance D3 is equal to distance D1 plus one-half of distance D2. Thereafter, the retaining recesses 44 are positioned apart by distance equal to distance D2. The last retaining recess 44 at the right end of and on the top side of the support member as illustrated in FIG. 3, is positioned a distance D4 from the opposite end thereof. Distance D4 is equal to distance D1 plus one-fourth of distance D2. Thus, when the support members are reversed and joined together along their center slots, each successive retaining recess around the circumference of support assembly 20 is separated by a distance equal to one-fourth of the distance D2 so that the recesses align in the desired helical path of fusible element 52.

Use of identical support members 24 and 26, joined together along center slots as described, permits the construction of a support assembly having fewer number of dissimilar parts. Further, terminator plates 22 are identical so that the entire four element assembly is fabricated of only two different parts thereby reducing manufacturing and storage costs.

Keyed opening 48 is formed in an hourglass shape with engaging projections 66 extending from opposite surfaces thereof for engaging the surfaces of first and second support members 24 and 26 so that the members cannot be twisted or rotated with respect to terminator plates 22 once assembly is completed. Further, since first and second support members 24 are relatively thin flat members, their total volume is quite small thereby maximizing the amount of electrically non-conducting material 30 that may be placed around fusible element 32. In addition, since the retaining recesses 44 only engage the fusible element 32 at very narrow points along the length of fusible element 32, there is very little area of the fusible element that is not surrounded by the insulating material 30. Thus, during fuse operation, fulgurite formation is not restricted as the fusible element vaporizes into the insulating material.

First and second support members 24 and 26 are preferably formed of an inorganic insulating material such as Mica. Even more preferably, first and second support members 24 and 26 are formed from Mica particles bonded together with an inorganic adhesive. However, a plastic resin adhesive may be used to bond the Mica particles. Such an inorganic insulating material does not vaporize due to the heat of fuse operation. However, if desired, an organic insulating material may be utilized for first and second support members 24 and 26. However, such an organic insulating material will produce a gas during fuse operation; and thus, cylindrical housing 12 must be designed to withstand the increased pressure resulting from gas formation. In some situations, it may be desirable to fabricate first and second support members from an organic insulating material that produces an arc quenching gas when exposed to the heat of fuse operation. Such an arc quenching gas may be used to facilitate arc extinction to interrupt current flow through the fuse.

Figure 7:
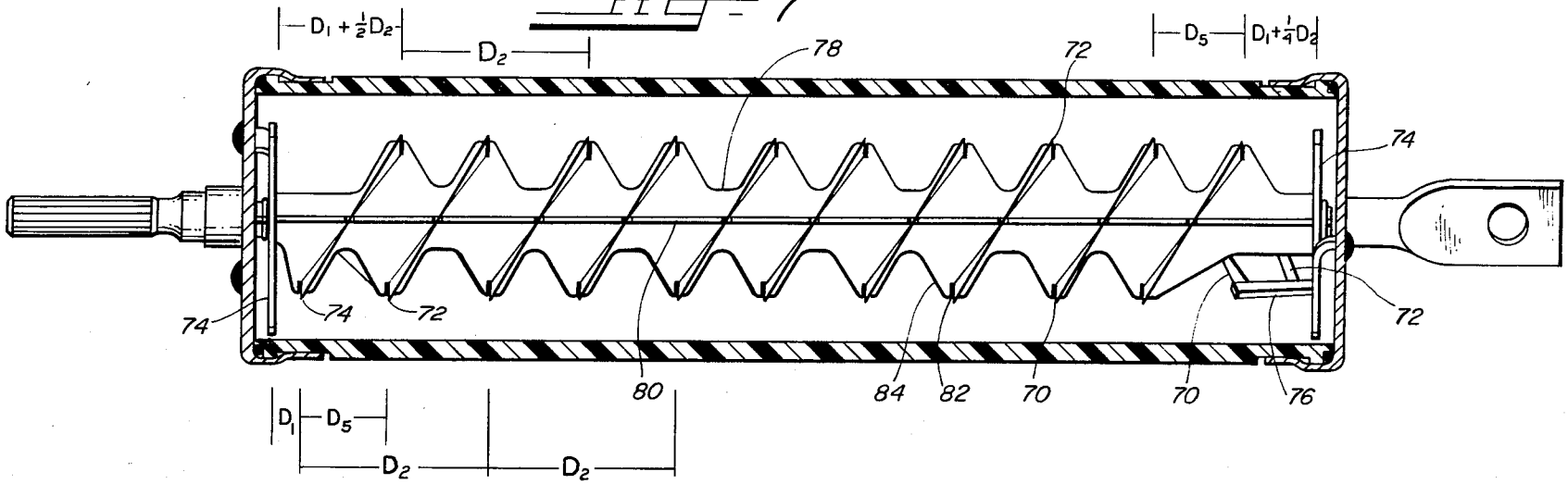
FIG. 7 is a side partially cross-sectional view of an alternative embodiment of the present invention.
Figure 5:
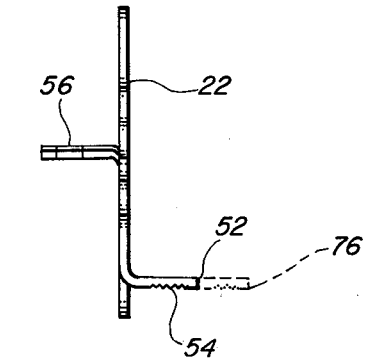
FIG. 5 is an edge view of the plate member taken substantially along line 5—5 in FIG. 4.

With reference to FIG. 7, an alternative embodiment of the present invention is illustrated. This embodiment is substantially the same as the FIG. 1 embodiment, except that provision is made for the helical winding of two fusible elements 70 and 72. Terminator plates 74 are substantially identical to terminator plates 22 in the FIG. 1 embodiment except that the serrated tab 76 is longer than the serrated tab 52 in the FIG. 1 embodiment so that the two fusible elements 70 and 72 can be welded to the same serrated tab. With reference to FIGS. 5 and 6, the relative length of the serrated tab 76 is illustrated in dotted lines.

First and second support members 78 and 80 are identical and are substantially the same as first and second support members 24 and 26 in the FIG. 1 embodiment except that the positional relationship of the fusible element retaining recesses 82 in the ends of projections 84 is slightly different in the FIG. 7 embodiment because of the double fusible element relationship. In particular, with reference to FIG. 7, the first recess on one side is positioned a distance D1 from the end of the support member 78 and thereafter, each recess for the first fusible element 70 on that side of the support member 78 is positioned a distance D2 apart. The second fusible element 72 on that side of support member 78 is positioned a distance D5 away from first recess and thereafter each recess for the second fusible element 72 on that side of support element 78 is positioned a distance D2 apart. On the opposite side of the support member 78, the first recess is positioned a distance of D1 plus one-half D2 from that end, and thereafter the recesses for the first fusible element 70 are positioned a distance D2 apart. The last recess on that side of the support member 78 is positioned a distance D1 plus one-fourth of D2 from the other end of the support member. This positional relationship will assure that when the first and second support members are reversed and joined together as illustrated in FIG. 7, the recesses will align to form the proper helical path for the double fusible element. The remaining constructural aspects of the FIG. 7 embodiment are substantially the same as the FIG. 1 embodiment. As may be readily seen, the support members may be easily designed to provide the proper path for any number of fusible elements.

It should be apparent that the present invention provides substantial advantages in reduced cost and manufacture. The present invention provides simple, easy assembly and there is no necessity for elaborate fixtures for either cementing or welding the support elements together. Further, the present invention provides for a minimum number of different parts for handling and storage; and thus, minimum storage space is required for parts. Further, the minimum volume of the support assembly 20 assures full utilization of the fuse volume for the arc quenching sand filler material.

It should be apparent that various changes, modifications, and variations may be made to the embodiments illustrated herein without departing from the spirit and scope of the present invention as defined in the appended claims.

I claim:

1. A support assembly for supporting in a predetermined three-dimensional helical path at least one fusible element within the body of a fuse comprising:

a first and a second support member, each of said support members identically formed of a sheetlike electrically non-conductive material and having a slot formed along the central axis thereof from one end to at least the middle thereof, and each of said support members having fusible element retaining recesses formed along the edges thereof in a predetermined positional relationship, said first and second support members being joined together along said slots approximately at right angles to each other with respect to said central axis, the predetermined positional relationship being such that the fusible element retaining recesses align to form the predetermined three-dimensional helical path of the fusible element when said first and second support members are joined.

2. A support assembly, as claimed in claim 1, further comprising means of maintaining said first and second support members in a fixed position within the fuse body.

3. A support assembly, as claimed in claim 1, wherein said first and second support members are fabricated from an inorganic insulating material.

4. A support assembly, as claimed in claim 3, wherein said inorganic insulating material is mica.

5. A support assembly, as claimed in claim 3, wherein said inorganic insulating material is mica particles bonded in sheet form by an inorganic adhesive.

6. A support assembly, as claimed in claim 3, wherein said inorganic insulating material is mica particles bonded in sheet form by a resin.

7. A support assembly, as claimed in claim 1, wherein said first and second support members are fabricated from an organic insulating material.

8. A support assembly, as claimed in claim 7, wherein said organic insulating material produces an arc quenching gas when exposed to an electrical arc.

9. A support assembly, as claimed in claim 1, wherein said element retaining recesses are positioned in the ends of projections extending from said first and second support members.

10. In a high voltage fuse including a hollow insulator housing, end walls sealing each end of the insulator housing, at least one fusible element wound in a predetermined helical path within the insulator housing, and an electrically non-conductive filler material in the insulator body surrounding the fusible element; an improved support assembly for the fusible element comprising:

a pair of identically shaped flat elongated support members formed of a thin electrically non-conductive material, each of said support members having a slot formed from one end along its center to at least the middle of said member, and each of said members having a plurality of fusible element support projections having element retaining recesses in the ends thereof extending from opposite edges of said support members, said support projections being positioned in a predetermined positional relationship, said support members being joined approximately perpendicular to one another so that said slots engage one another, the predetermined positional relationship of said support projections being such that the element retaining recesses in the ends of said projections form the predetermined helical path of the fusible element so that the fusible element engages said recesses and is supported within the insulator housing when said support members are joined.

11. An improved support assembly, as claimed in claim 11, further comprising means for maintaining said first and second support members in a fixed position within the hollow insulator housing.

12. An improved support assembly, as claimed in claim 10, wherein the first and said element retaining recesses in the end of the first support projection from one end of and on one side of said first and second support members is positioned a first predetermined distance from that one end of said first and second support members, and thereafter, said element retaining recesses on that one side are positioned a second predetermined distance apart, and the first of said element retaining recesses in the end of the first support projection from that one end of said first and second support members on the other side of said first and second support members is positioned a third distance from that one end of said first and second support members equal to the first distance plus one-half the second distance, and thereafter, the element retaining recesses are positioned the second predetermined distance apart, and last element retaining recess on that other side being positioned from the other end of said first and second support members by a fourth distance equal to the first distance plus one-fourth the second distance;

whereby when said first and second support members are joined together along their respective slots, said retaining recesses from the desired helical path for a single fusible element.

13. An improved support assembly, as claimed in claim 10, wherein said first and second support members are fabricated from an inorganic insulating material.

14. An improved support assembly, as claimed in claim 13, wherein said inorganic insulating material is mica.

15. A support assembly, as claimed in claim 13, wherein said inorganic insulating material is mica particles bonded in sheet form by an inorganic adhesive.

16. A support assembly, as claimed in claim 13, wherein said inorganic insulating material is mica particles bonded in sheet form by a resin.

17. An improved support assembly, as claimed in claim 10, wherein said first and second support members are fabricated from an organic insulating material.

18. An improved support assembly, as claimed in claim 17, wherein said organic insulating material produces an arc quenching gas when exposed to an electrical arc.

19. An improved support assembly, as claimed in claim 10, wherein the first of said element retaining recesses in the ends of the first support projection from one end of and on one side of said first and second support members is positioned a first predetermined distance from that one end of said first and second support members, and thereafter, said element retaining recesses on that one side are positioned a second predetermined distance apart, and the first of said element retaining recesses in the end of the first support projection from that one end of said first and second support members on the other side of said first and second support members is positioned a third distance from that one end equal to the first distance plus the second distance, and thereafter, the element retaining recesses are positioned the second distance apart, and the last element retaining recess on that other side being positioned from the other end of said first and second support members by a fourth distance equal to the first distance plus one-half the second distance;

whereby when said first and second support members are joined together along their respective slots, said retaining recesses form the desired helical path for two fusible elements.

20. An improved support for mounting a fusible element within a cylindrical housing which contains a granular non-conducting medium surrounding the element, the housing including means for maintaining the support generally coaxial with the housing, wherein the improvement comprises:

a pair of identical, planar members having elongated edges, with spaced projections thereon, the projections on one edge of each member generally, transversely opposing spaces between projections on the other edge thereof;

means on each projection for retaining a portion of the fusible element therein; and a central slot formed longitudinally through each member between the edges thereof, the members being joinable together along their respective slots with their major surfaces angularly related to form the support so that the retaining means define a generally helical path circumferentially of the support.

21. The support of claim 20 wherein the distance between the retaining means on adjacent projections on the same edge of the same member is $D_2$, and the distance longitudinally of the support between a retaining means on a given projection on one member and retaining means on adjacent projections on the other member is $D_2/4$.

* * * * *